United States Patent [19]

Moser et al.

[11] 4,101,189

[45] Jul. 18, 1978

[54] DISCRETE WIRE INTERCONNECTIONS FOR CONNECTOR BLOCKS

[75] Inventors: Jessie Lee Moser, Highpoint; John Robert Shoemaker, Walkertown; Melvin Andrew Soderstrom, Advance, all of N.C.

[73] Assignee: AMP Incorporated, Harrisburg, Pa.

[21] Appl. No.: 802,326

[22] Filed: Jun. 1, 1977

[51] Int. Cl.[2] ..... H01R 13/38

[52] U.S. Cl. ..... 339/99 R; 339/103 M

[58] Field of Search ..... 339/97 R, 97 P, 98, 339/99 R, 103

[56] References Cited

U.S. PATENT DOCUMENTS

| | | | |
|---|---|---|---|
| 3,760,331 | 9/1973 | Gurley | 339/97 P |
| 3,854,114 | 12/1974 | Kloth et al. | 339/97 R |
| 3,976,350 | 8/1976 | Keglewitsch | 339/97 P |
| 4,009,922 | 3/1977 | Aysta | 339/99 R |

*Primary Examiner*—Joseph H. McGlynn
*Attorney, Agent, or Firm*—Gerald K. Kita

[57] ABSTRACT

This invention relates to a card edge connector, multiple numbers of which are arranged in banks and interconnected by discrete wires. The present invention provides a system for lacing wires through passageways and channels, thereby aligning the wires for insertion within slotted plate electrical contacts. One or a pair of wires may be inserted in each contact. Wire gripping strain relief is provided in each of the wire aligning passageways. The passageways and channels position the wire in an orderly arrangement in different planes within the connectors. Wire retention gates prevent removal of the wires from the channels and passageways.

5 Claims, 4 Drawing Figures

DISCRETE WIRE INTERCONNECTIONS FOR CONNECTOR BLOCKS

BACKGROUND OF THE INVENTION

The present invention relates to interconnecting an array of electrical contacts with discrete wires, and more particularly to discrete wire interconnection of a bank of card edge connectors. In use the connectors pluggably receive the edges of printed circuit cards therein. The connectors are provided with electrical contacts, first ends of which engage the printed circuit cards. Opposite ends of the contacts are called tails and project outwardly of the connectors for interconnection by discrete wires. In the past the tails were in the form of posts which were interconnected by wrapping wires around the posts. There has been a long existing need for a system which eliminates the time consumption required for making wrapping type connections and which eliminates wire entanglement.

BRIEF DESCRIPTION

In the present invention the card edge contacts are provided with tail portions in the form of slotted plate contacts into which may be connected one or a pair of interconnection wires. Wire connections are made quickly by inserting a discrete wire along a contact slot, as opposed to the time consuming procedure of wrapping the wire around the contact tail. Resilient slicing jaws are provided adjacent each side of a contact slot which slice through the insulation sheath of a wire to make electrical contact with the wire conductor. The connector block defines wire alignment passageways into which the wires are laced and thereby aligned for insertion in slotted contacts. The passageways also arrange the wires in an orderly array to prevent wire entanglement. The wire aligning passageways include ribs which grip the wire to provide strain relief. A passive keeper or retention gate in the passageways prevent removal of the wires therefrom. Certain contact tail portions are bussed together by common bussing wires. In such cases the bussing wires are readily identified and arranged in orderly array separate from the remainder of interconnecting wires. This is accomplished by wire alignment channels provided on each connector block which support bussing wires in an elevated plane with respect to the remainder of the interconnecting wires. Passive keepers provided on the connector blocks prevent removal of the bussing wires from the alignment channels. Both the passageways and channels are substantially elongated in a direction transversely of the connector block to support and align corresponding lengthy sections of the interconnecting and bussing wires in orderly arrays. It has been found that the substantial lengthy passageways and channels provide relatively large targets which are easy to see and find upon aligning and inserting wires therein. Wiring mistakes and operator fatigue are thereby reduced.

OBJECTS

It is an object of the present invention to provide a connector block having contacts with slotted plate tail portions projecting outwardly of the block for connection of discrete wires thereto, the block including wire alignment passageways and elevated wire alignment channels supporting wires in plural planes and arranging the wires in an orderly array.

Another object of the present invention is to provide a wiring system for a bank of connector blocks which are capable of interconnection by discrete wires, the blocks including rows of electrical contacts therein having outwardly projecting tail portions to which wire insertion connections may be made, the block further including wire alignment passageways providing target areas for aligning wires prior to insertion in the contact tail portions and for captivating inserting wires in place, the block further including elevated wire alignment channels for aligning and supporting additional interconnection wires in a plane elevated above the wire alignment passageways and for captivating the additional wires in an orderly arrangement.

Another object of the present invention is to provide a connector block with electrical contacts having slotted plate tail portions projecting outwardly of the block and capable of interconnection by discrete wires, the block including wire alignment passageways providing target areas for aligning the wires prior to insertion in the slotted plates and for captivating and aligning inserted wires in an orderly array, the block further including wire alignment channels for captivating and arranging additional wires in an orderly array within a plane elevated with respect to the wire alignment passageways.

Other objects and many attendant advantages of the present invention will become apparent from the detailed description and accompanying drawings.

DETAILED DESCRIPTION

Figure 1:
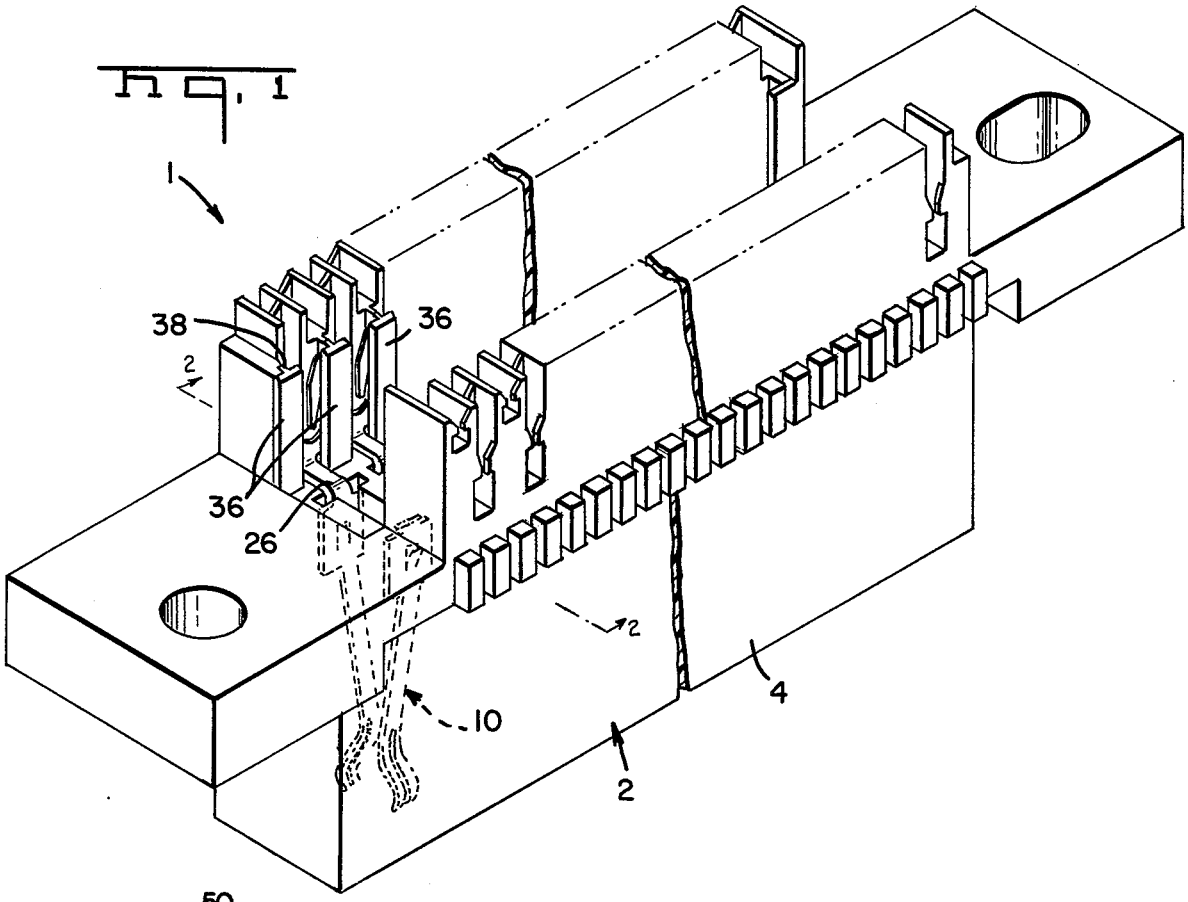
FIG. 1 is an enlarged fragmentary perspective of a connector block according to the present invention, with preferred embodiments of the wiring system incorporated therein.
Figure 2:
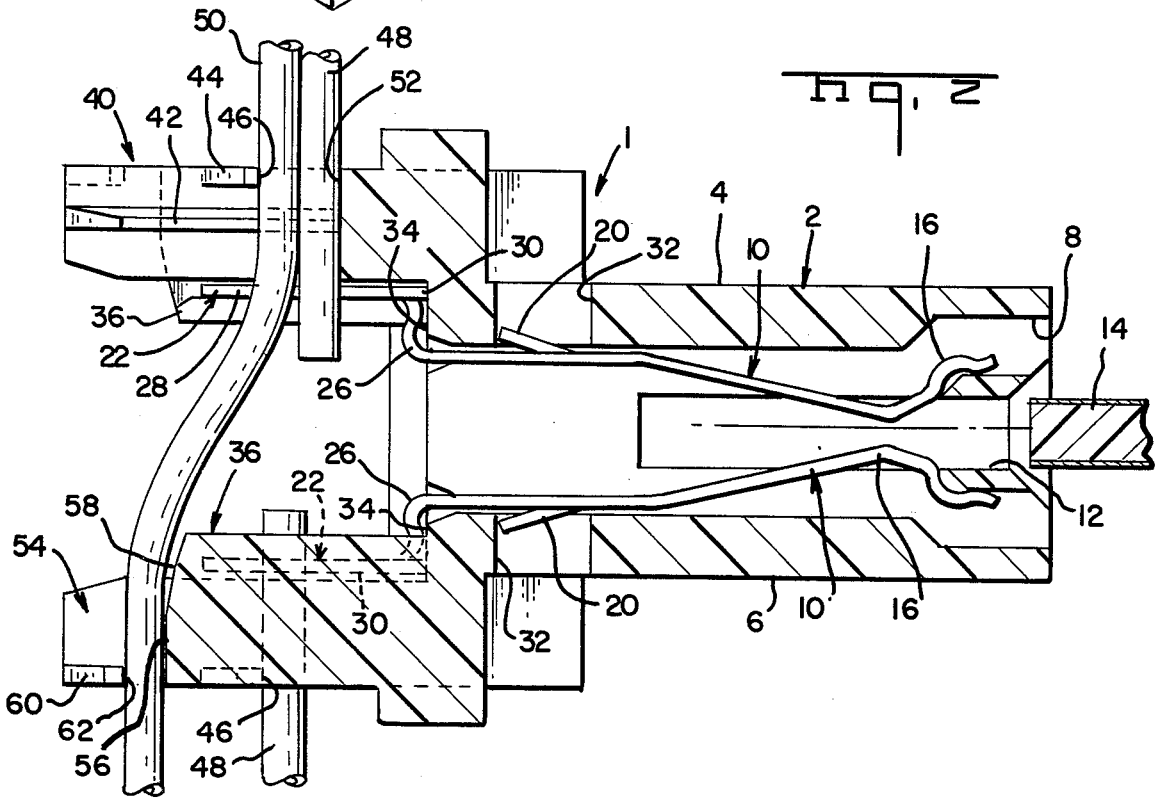
FIG. 2 is an enlarged transverse section taken along the line 2—2 of FIG. 1.

With more particular reference to the drawings there is illustrated in FIGS. 1 and 2 a preferred embodiment of a connector block generally illustrated at 1 which is molded from insulation material and includes a generally elongated housing portion 2 with two parallel elongated sidewalls 4 and 6. The housing 2 includes an inner enlarged cavity 8 in which are mounted two rows of opposed electrical contacts generally illustrated at 10, the details of which will be described in detail. The housing 2 further includes an elongated inner cavity 12 of reduced width for slidably receiving therein an edge margin of a printed circuit board or card 14. In accordance with standard practice, the contacts 10 are capable of resilient deflection within the cavity 8 toward and away from the cavity 12. When the printed circuit card 14 is inserted into the cavity 12 and between the rows of contacts 10, the contacts will resiliently engage circuit paths provided on the card providing electrical connection thereto as desired.

Figure 4:
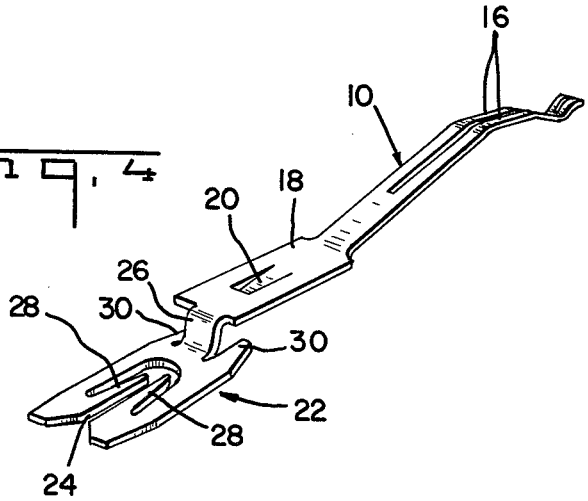
FIG. 4 is an enlarged perspective of an electrical contact provided in the connector block of the preferred embodiment and further illustrating a tail portion in the form of a slotted plate contact incorporated into the wiring system portion as illustrated in FIG. 3.

As more particularly shown in FIGS. 2 and 4 each contact 10 is provided at one end with a pair of tines 16 which are resilient cantilever beam wiping contacts mounted in opposed rows within the housing portion 2. Each contact 10 further includes a central portion 18 from which is struck out a tine 20. The other end of each contact 10 includes a tail portion 22 in the form of a slotted plate contact portion 22 of the type described in detail in U.S. Pat. No. 3,950,062. The slotted plate 22 is symmetrical on either side of a central slot 24 which is open at one end. The slotted plate 22 includes a reduced neck portion 26 in alignment with the slot 24. The neck portion 26 is reversely curved and connects the contact portion 22 slightly offset in each of two directions transversely of the major axis of the contact 10. Slotted plate 22 provides a pair of wire gripping jaws 28 on either side of the central slot 24, which jaws are capable of slicing through insulation on a wire or a pair of wires and grippingly engaging the conductor of the wire of a pair of wires to make electrical contact therewith. The slotted plate 22 further includes a pair of spaced flukes 30 adjacent the narrow neck 26.

Figure 3:
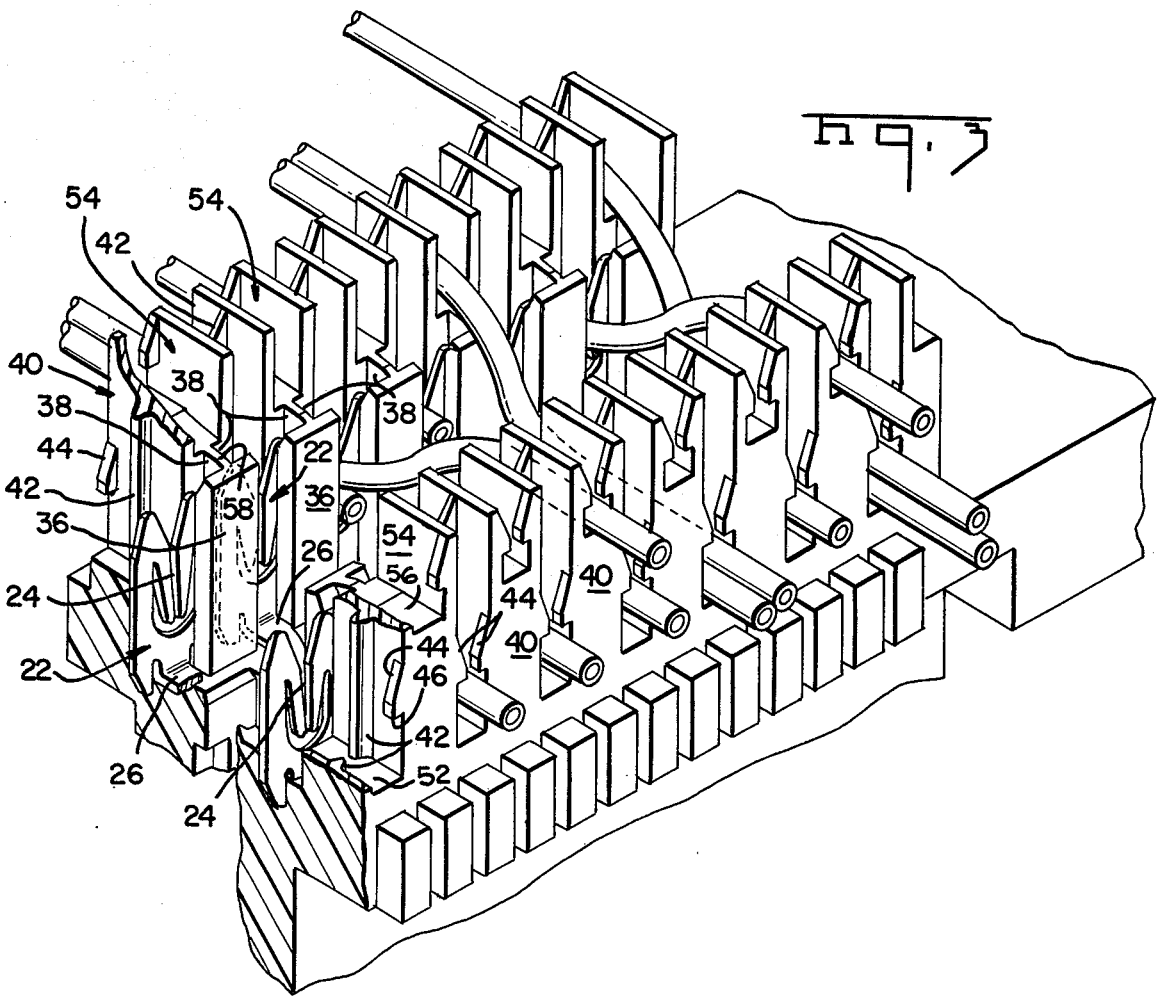
FIG. 3 is an enlarged fragmentary perspective of a portion of the preferred embodiment illustrated in FIG. 1 illustrating the wiring system portion thereof.

As shown more particularly in FIG. 2 the housing 2 is provided with recesses 32 into which the tines 20 are latchably received. The housing 2 further includes shoulder portions 34 against which the flukes 30 are supported. Portions of the housing 2 therefore are laterally received between the tines 20 and the flukes 30 of the contacts 10, thereby to position the contacts in the housing. The housing 2 further is provided with integral and outwardly projecting flanges 36 which are shown in FIGS. 1 and 3 arranged in rows on opposite sides of the central axis of the connector block 1. Grooves 38 are provided along the sides of the flanges facing the spaces defined between adjacent flanges. The slotted plates 22 span across the spaces between adjacent flanges, and the side margins of the contacts are received in the grooves which are mutually aligned. The neck portions 26 of the slotted plates together with corresponding central slot portions 24 are aligned with the spaces between the flanges 36. The flanges 36 therefore provide support across the thickness of the contacts preventing buckling of the same during wire insertion. Further the grooves 38 are sufficiently deep to allow for biasing apart the jaws on either side of the slot 24 upon receipt of one or a pair of wires therein. The flanges 36 are integrally joined to corresponding rows of columnar projections 40 integral with and outwardly projecting from the housing portion 2 of the block 1. The spaces between adjacent projections 40 are in alignment with the slots 24 and define wire aligning passageways for initially receiving and guiding a discrete wire for insertion thereof with a corresponding slot 24. The projections 40 are sufficiently thick such that the passageways are relatively lengthy and therefore provide large target areas which are easy to see and to find when the wires are positioned for insertion therein. Additionally the lengthy passageways are parallel with each other tending to arrange inserted wires in orderly parallel rows. The projections 40 further includes mutually aligned projecting ribs 42 projecting into the passageways and aligned in the direction of wire insertion into the passageways. The ribs grip inserted wires on opposite sides thereof serving as a strain relief whereby pull out of the wires from the jaws of the contacts 22 is prevented. In addition the columnar projections 40 are provided with projecting ears 44 facing into the passageways. The ears are in alignment and are progressively tapered to form a progressively narrowed constriction past which wires must be forced when inserted into the passageways. The ears have inverted shoulders 46 which form keepers which captivate the wires in the passageways to prevent dislodging the inserted wires from their orderly arrangement in rows. The sufficiently lengthy passageways allow the slots 24, the ribs 42 and the ears 44 to be in tandem relationship. Accordingly connection of the wire to the contacts 22, strain relief of the wires when gripped by the ribs 42 and retention of the wires by the ears 46 are three functions which are substantially spaced from one another and along a relatively lengthy portion of the wire.

As more particularly shown in FIGS. 2 and 3 interconnecting wires illustrated at 48 have their end portions inserted within the passageways between columnar projections 40. End portions of the wires 48 are terminated in between the wire gripping jaws 28 which have slicing edges thereon on either side of the slot 24 which slice through the insulation on the wires 48 and compressively engage the conductors of the wires 48. The wires 48 further are captivated beneath the inverted shoulders 46 of the ears 44 and are gripped on opposite sides by the ribs 42. Since the contacts 22 are capable of electrical connection to either one or a pair of wires, additional wires 50 are illustrated as spanning transversely across the block. The additional wires 50 are inserted between the wire gripping jaws of the contacts 22. And if a wire 48 is already present in the wire receiving passageway, the wire 50 will impinge against the wire 48 forcing it further into the passageway until it seats against a bottom wall 52 of the passageway. The passageways which are lengthy in a direction transverse to the connector block therefore arrange corresponding lengthy sections of the wires 48 and 50 in orderly rows. The bottom walls 52 of the passageways are generally coplanar defining a first plane of support for the wires 48. Additionally, the inverted shoulders 46 of the ears 44 are coplanar defining a second plane of support for the wires 50 which are impinged against the wires 48. For those slotted contact portions which receive only the wires 48 therein such wires 48 are supported in the second plane of support until insertion of additional wires 50 force the wires 48 to the first plane of support.

As shown more particularly in FIGS. 2 and 3, the ends of the projections 40 are provided with recessed wire aligning channels 54 which are substantially lengthy in directions transverse to the connector block. The channels 54 of one row of projections 40 are in alignment with the wire receiving passageways between the projections 40 of the opposite row. The wires 50 which span transversely across the connector block are inserted into the channels 54. The channels include coplanar bottom walls 56 portions of which are inclined toward the passageways and more particularly toward the second plane of wire support. The bottom walls 56 further are contiguous with end surfaces 58 of the flanges 36 which surfaces 58 also are inclined toward the second plane of wire support. The wires 60 therefore not only span across the connector block but also span from the second plane of wire support to a third elevated plane of wire support defined by the bottom walls 56 of the channels 54. The bottom walls 56 and the inclined end surfaces 58 support lengthy inclined sections of the wires 50 which bridge across the connector block. The projections 40 are provided with additional ears 60 with inverted shoulders 62 serving as keepers to captivate the wires 50 within the channels 54. The ears 60 are similar therefore to the ears 44. The inverted shoulders 62 are spaced from the bottom walls 56 a distance greater than the diameter of one wire 50 but less than the diameter of two wires 50. By contrast the inverted shoulders 46 are spaced above the bottom walls 52 a distance sufficient to accommodate both a wire 48 and a wire 50 in the passageways.

The channels 54 further are substantially lengthy in a direction transverse to the connector block to align corresponding lengthy sections of the wires 50 in orderly rows in a third plane of wire support.

Although preferred embodiments of the present invention has been illustrated and described in detail other embodiments and modifications thereof which would be apparent to one having ordinary skill in the art are intended to be covered by the spirit and scope of the appended claims.

What is claimed is:

1. In a connector block capable of being interconnected by discrete wires, the improvement comprising:

first and second rows of electrical contacts along opposite sides of said block having resilient contacts on opposite sides of a central cavity of said block and tail portions in the form of slotted plates projecting outwardly of said block, said block including two rows of supporting flanges provided with aligned grooves facing the spaces defined between adjacent flanges, the slotted plates of said contacts bridging across the spaces between adjacent flanges and the side margins of said slotted plates being received in the aligned grooves, said block further including first and second rows of columnar projections defining elongated wire aligning passageways in alignment with adjacent wire gripping jaws of said slotted plate contacts, said projections further including wire gripping ribs in said passageways for gripping wires aligned along said passageways and terminated to said wire gripping jaws, said projections further including keeper means preventing removal of wires inserted along said passageways, said projections further including wire aligning elongated channels aligned with said wire receiving passageways of the opposite rows of projections, whereby wires aligned in said channels span transversely across said block and are terminated to wire receiving jaws of slotted plate contacts adjacent said opposed row of projections and are gripped by said ribs in said wire receiving passageways.

2. The structure as recited in claim 1, and further including:

keeper means provided in said channels and spaced from said bottom walls of said channels a distance sufficient to receive single wires in said channels, and said keeper means of said passageways being spaced from bottom walls of said passageways a distance sufficient to receive either single wires or pairs of wires in said passageways.

3. The structure as recited in claim 1 wherein said passageways include bottom walls for laterally supporting wires on a first plane intersecting said slotted plates.

4. The structure as recited in claim 3, wherein said channels include bottom walls for supporting wires in a second plane elevated from said wire aligning passageways and beyond the ends of said slotted plates.

5. The structure as recited in claim 3, wherein the end surfaces of said flanges merge with the channel bottom walls and are inclined toward said first plane to support inclined portions of wires which span across said block and are inclined from said passageways toward said channels.

* * * * *